United States Patent [19]

Nordstrom

[11] Patent Number: 4,976,352

[45] Date of Patent: Dec. 11, 1990

[54] CAMERA BAG

[75] Inventor: Mark B. Nordstrom, Evergreen, Colo.

[73] Assignee: Samsonite Corporation, Denver, Colo.

[21] Appl. No.: 201,006

[22] Filed: Jun. 1, 1988

[51] Int. Cl.[5] ..... A45C 11/38; A45C 13/10; A45C 13/26

[52] U.S. Cl. ..... 206/316.2; 224/202; 224/224; 224/908

[58] Field of Search ..... 150/525, 154, 129; 206/316, 316.2, 316.1; D3/33; 190/110, 125; 224/202, 224, 908

[56] References Cited

U.S. PATENT DOCUMENTS

| | | | |
|---|---|---|---|
| D. 194,139 | 11/1962 | Parsell | D3/33 |
| D. 210,646 | 3/1968 | Everburg . | |
| D. 217,414 | 4/1970 | Lang et al. . | |
| D. 250,225 | 11/1978 | Sykes . | |
| D. 257,906 | 1/1981 | Weinreb | D3/33 |
| D. 268,711 | 4/1983 | Outcalt | D3/33 |
| D. 270,494 | 9/1983 | Koszegi | D3/33 |
| D, 273,533 | 4/1984 | Weinreb | D3/33 |
| D. 280,465 | 9/1985 | Baum | D3/33 |
| D. 281,463 | 11/1985 | Rodrigues | D3/33 |
| D. 289,106 | 4/1987 | Leiserson | D3/33 |
| 2,665,801 | 1/1954 | Berkman | 206/316 X |
| 2,691,401 | 10/1954 | Kontoff et al. | 150/52 T |
| 2,960,137 | 11/1960 | Lipsitz | 150/52 J |
| 3,910,470 | 10/1975 | Swenson et al. | 150/52 T X |
| 4,135,045 | 2/1979 | Baker | 150/52 J X |
| 4,323,180 | 4/1982 | Sloop . | |
| 4,424,841 | 1/1984 | Smith | 190/110 X |
| 4,610,286 | 9/1986 | Cyr | 150/52 J |
| 4,620,579 | 11/1986 | Lowe et al. | 150/52 T |

FOREIGN PATENT DOCUMENTS

| | | | |
|---|---|---|---|
| 3040915 | 6/1982 | Fed. Rep. of Germany | 206/316 |
| 1201622 | 7/1959 | France | 206/316 |

*Primary Examiner*—Sue A. Weaver
*Attorney, Agent, or Firm*—Gregory W. O'Connor

[57] ABSTRACT

Personal luggage specific for camera equipment, sometimes known as camera bags, have been designed to permit ready access to the equipment, yet secure that equipment for transport. Such bags have been bulky and uncomfortable, and the conflicting goals of securing the equipment but providing ready access have resulted in a number of design compromises.

Accordingly, the camera bag 1 includes an upper portion which has a handle facet 60 which carries handle 62 adjacent a relatively angled lid portion 10. The handle facet is adjacent to a body side panel 20, which normally is tangent to the body of the user of the bag. The lid 10 is operated to hinge around the upper edge of the front panel 40 of the bag. This permits a lid pocket 90 to be deployed simultaneously with the opening and pivoting of the lid 10. When the lid 10 is in the open position, the main packing compartment and a substantial accessory compartment 90 are presented to the user. While the lid is in the closed condition, substantially all of the packing compartments are secured readily by operation of the zipper slider 13.

12 Claims, 3 Drawing Sheets

CAMERA BAG

FIELD OF THE INVENTION

The subject invention relates to personal luggage, and particularly to luggage specifically designed to carry photographic equipment, video cameras (sometimes known as camcorders), and related equipment. Such luggage, generally known as camera bags or camcorder cases, are carried with the use of a handle and/or with the use of a carry strap normally placed on the shoulder of the user. These camera bags generally have a main packing compartment and at least one other additional compartment adjacent to but separate from the main packing compartment for containing accessories such as film or video cassettes.

BACKGROUND OF THE PRIOR ART

Camera bags or camcorder cases present problems similar to other personal luggage except these problems are compounded by the nature of the goods carried and the use to which the cases are put. Specifically, the camera bag must permit ready access to the contents so that the user can operate the cameras for taking pictures or for preparing camera equipment to take such pictures. Simultaneously, the contents should be readily secured against spilling or against unauthorized access. The need for ready access and the need to selectively secure the contents tend to be conflicting goals of camera bag design. Such conflicts are often resolved at the sacrifice of one of the two functions. Thirdly, most camera bags permit carrying by a carry strap, often called a shoulder strap. This permits the user to free both hands for access and operation of the camera equipment contained in the camera bag. A carry strap or shoulder strap is often not the best means for carrying the camera bag by hand. Thus, many designs include a separate handle for hand carrying of the bag, or provide a system for adjusting the shoulder strap to approximate the carrying characteristics of a handle, usually by shortening to the shoulder strap and bringing the loop portion of the strap in close proximity to the top of the camera bag. There are many examples represented by prior patents of camera bags of the generally outlined type.

One practical solution for access and ease of carrying of the bag would be to provide a generally rectangular lid fastened to the upper portion of a box-like camera case. Such box-like constructions are shown in U.S. Pat. No. 2,960,137 and design patent Ser. Nos. 270,494; 217,414 and 273,533. In each of these patents, a shoulder strap is also provided attached to the end panels of the generally rectangular box-like construction with the lid portion positioned between these end panels.

Often, the need for greater access to the interior of the main packing compartment of such camera bags results in concepts which include both a lid and front panel opening operation. Such lid and front panel opening cases may be typified by design Ser. Nos. 289,106; 210,646; 280,465; 281,463 and 250,225; and U.S. Pat. No. 4,323,180. A drawback of such systems includes the need to secure the front panel and lid in a closed position when moving, running or jogging, to prevent the equipment from falling out. Alternatively, a complex system of dividers and straps can be provided, but this tends to defeat the benefit of providing wide open panel construction for ready access.

Another approach to the dichotomy of security/easy access is the provision of many separate compartments so that individual access can be had to the several compartments. Such systems are shown in design Ser. Nos. 268,711; 257,906 and U.S. Pat. No. 4,610,286. However, this solution is not always satisfactory, since each of the several compartments must be separately closed in order to assure that the contents will not spill.

Thus, camera bags have been designed to compromise in some manner each of the basic functions or demands placed on the camera bag, that of ready access, quick securing of the contents, and ease of carrying either by a shoulder strap or handle.

SUMMARY OF THE INVENTION

It is an object of the instant invention to provide a personal luggage for carrying camcorders, camera equipment and such which provides ready access to the main packing compartment, yet permits rapid securing of the main packing compartment and main auxiliary compartment. It is a further object of the instant invention to provide a camera bag which, when carried by a carry strap, permits ready access to the fastening means for the lid for the main packing compartment. It is a further object of the instant invention to provide a camera bag that includes a carry handle positioned such that the carry handle can be used to support the camera bag both without the carry strap and during placement of the carry strap around either the shoulder or waist of the user. It is a further object of the instant invention to provide a camera bag with a lid which provides ready access to the main packing compartment while simultaneously deploying an auxiliary packing compartment located on the underneath side of the lid for ready access by the user when the camera bag is carried by the user on a shoulder strap or waist strap.

Accordingly, a hand luggage for carrying camera equipment and the like is disclosed comprising a bag having a bottom panel, an upper portion including an openable lid for access to a main packing compartment, first and second end panels, a body side panel and a front side panel, and means for attaching a carrying strap to the bag. This upper portion includes a handle facet, which is connected to and upwardly positioned from the body side panel. This handle facet forms an angle with the body side panel and with the lid whereby when the bag is carried by the carry strap with the body side panel against the body of the user of the bag, the lid is spaced away from the body of the user by the handle facet.

Also disclosed is a camera bag for carrying video camera equipment and the like comprising a generally rectangular lower portion including a bottom panel, first and second end panels, a body side panel and a front panel, an upper portion comprising a handle facet and a generally planar lid, said lid comprising a majority of the upwardly facing parts of said upper portion. The lid includes releasable fastening means along its juncture with the handle facet and the end panels, so that the lid may be opened to pivot about its juncture with the front side. The lid forms a generally acute angle with the body side panel when the lid is closed and is positioned substantially parallel to said front panel when said lid is opened about its juncture with said front panel. The lid includes a lid pocket positioned on the inside face thereof, such that the pocket is contained within a main packing compartment of the camera bag when the lid is in a closed position and the lid pocket is in an accessible, substantially vertical condition when the lid pocket is in an open position.

Also disclosed is a novel construction for a camera bag or the like comprising a first web including a handle facet portion, a first end panel portion, and a second end panel portion. This first web comprises a substantially continuous laminate. The construction also includes a generally planar body side panel and bottom panel integrally formed therewith at right angles thereto and a front panel having a generally rectangular planar shape. The body side panel and bottom panels are fastened along a continuous edge portion of the first web, and the front panel is fastened at end portions of said first web. Thus, when assembled, a main packing compartment of the bag is formed defined by first and second end panels which are substantially parallel to one another, a body side panel which is at a substantial right angle to said first and second end panels and parallel to and spaced from said front panel. The handle facet forms an obtuse angle with said body side panel.

DETAILED DESCRIPTION OF THE PREFERRED EMBODIMENT

Figure 1:
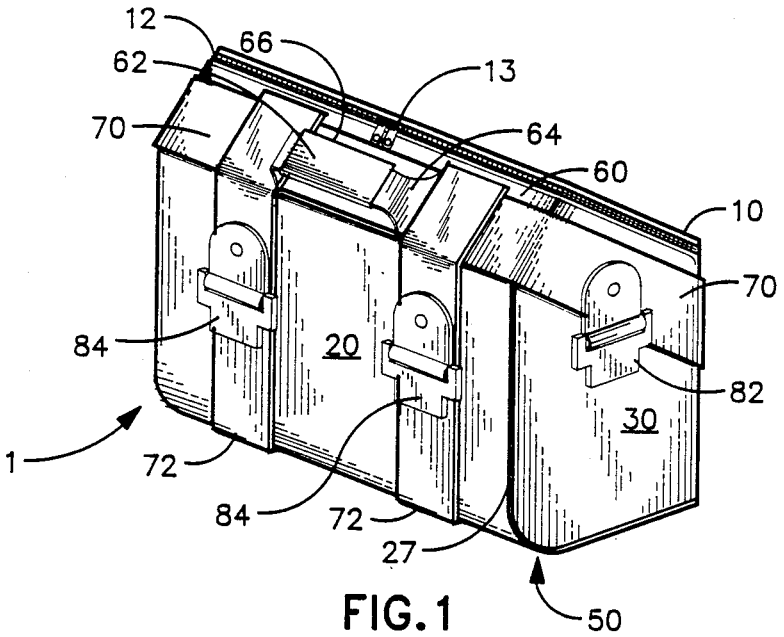
FIG. 1 shows a camera bag of the instant invention with the lid closed.

Turning initially to FIG. 1, the camera bag 1 is shown with the body side panel 20 facing to the left and an end panel 30 facing to the right as shown. By the term "body side panel," it is meant that that panel is normally positioned against the body (usually the hip, abdomen, or lower back area) when the camera bag is carried either by the shoulder strap S positioned around the waist of the user (FIG. 4) or about a shoulder of the user (FIG. 5), or by the carry handle 62. The bottom of the bag 1 is defined by bottom panel 50. The upper portion of the bag comprises two panels—a handle facet 60 tangent to the body side panel 20, and a lid 10 which is releasably connected to the upper edge of the handle facet 60 by a zipper 12, and to the upper edges of the end panels 30 and 31 also by the zipper 12. Also shown are means for releasably attaching the carry strap S comprising buckles 82 (only one shown in FIG. 1), which are used to attach the carry strap when it is used as a shoulder strap, and buckles 84 and 84, which are used to attach the carry strap S when used as a waist strap. Preferably, piping 27 is positioned along the seam which forms the intersection between the body side panel and the bottom panel extending therefrom with the end panels and the lower edge of the handle facet. The closure zipper 12 for the lid 10 is operated by a pair of zipper sliders 13, here shown positioned centrally at the upper edge of the lid 10.

The handle facet 60 carries a handle 62, which is used to carry the bag by hand. The handle 62 comprises a web loop 64 and a thin wrapping of leather-like material 66. The resulting handle is relatively soft, flexible and compact, and folds against the handle facet 60 and out of the way when not in use. The web loop 64 is preferably a continuation of a continuous strip of webbing 70 which extends the entire longitudinal dimension of the facet 60 and around the upper portions of end panels 30 and 31. The body side panel 20 is provided vertically extending strips of webbing 72 on which the buckles 84 are positioned.

Figure 2:
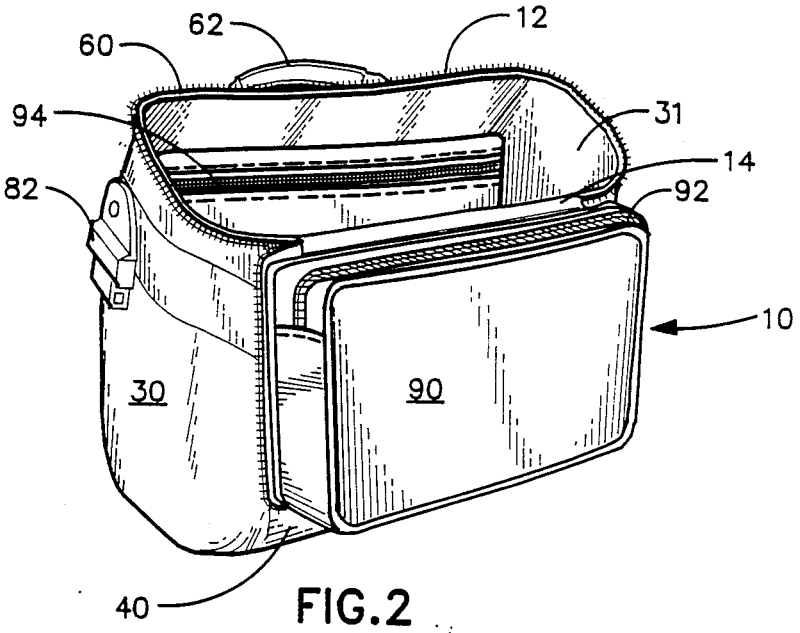
FIG 2 shows the camera bag from a different angle with the lid opened.

The lid 10 is releasably attached to the juncture of the handle facet and the end panels, and is hingedly attached to the upper edge of the front panel 40 via a cloth hinge or the like, shown as 14 (FIG. 2).

FIG. 2 shows the lid in the open position. Here, the zipper sliders 13 on the zipper 12 have been moved to underlie hinge means 14 and are thus not shown. The lid 10 has been folded at the hinge means 14 and now lies substantially vertically against the outside of front panel 40. On the inside surface of the lid 10 is positioned a substantial pouch or pocket 90, which includes an operable closure, preferably a zipper 92, along at least its upper edge (upper being defined when the lid is opened as shown in FIG. 2). Note that when the lid is closed, this "upper edge" becomes the lower most edge of the pocket 90. Thus, the closure member 92 should be such to prevent the contents from readily spilling into the main packing compartment.

In FIG. 2, the interior or main packing compartment of the bag is revealed. It preferably includes an inner zippered pocket 94 positioned along the inside surface of the body side panel 20. The interior surface of the other end panel 31 is shown to be substantially unadorned. Small pockets closed by elastic strips may be provided in the inside surface of these end panels, but this is not necessary.

Figure 3:
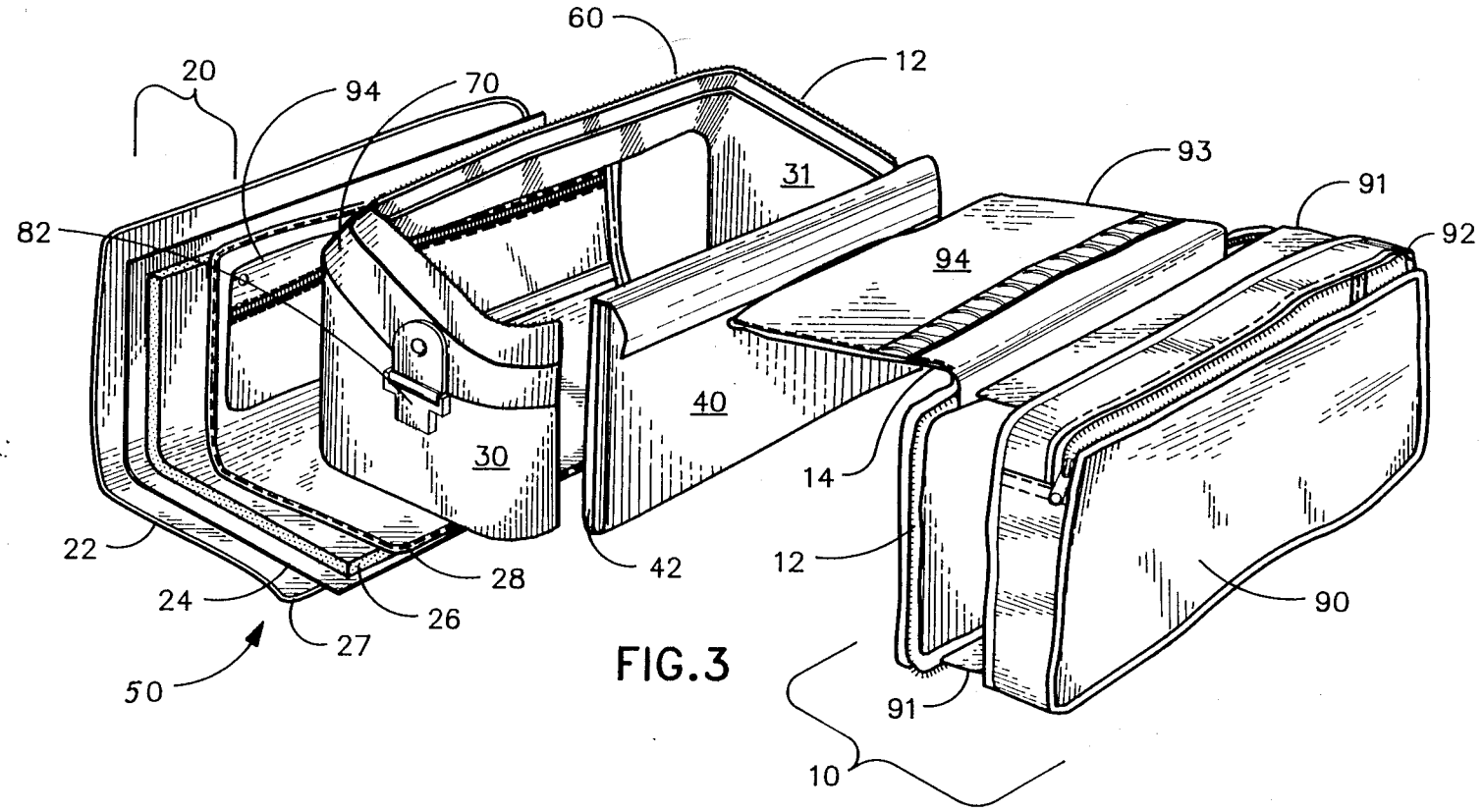
FIG. 3 shows an exploded view of the main portions of the camera bag.

The construction of the main portion of the bag 1 will be detailed with reference to FIG. 3. The end panels 30 and 31 and the handle facet 60 are preferably constructed of one piece or web of fabric or vinyl material in the shape of a dog bone or dumbbell when laid out flat. The webbing 70 is sewn in place along the upper edge of each end panel 30 and 31 and along the longitudinal extent of the handle facet 60 as shown. The body side panel 20 and bottom 50 are preferably constructed integral with one another. Shown here are a series of generally rectangular members making up the layers of this integral construction. Outermost is a layer of fabric 22 of a similar type to that making up the end panels and handle facets. A stiffening member, preferably of a sheet 24 of polypropylene, is shown, as is a layer 26 of elastic foam material. The sandwich is completed by an interior lining 28, which preferably includes a small elastic pocket or envelope 94 sewn to the inner surface of the lining 28. Each is bent to form this bottom panel 50 at a right angle to the body side panel 20. The last substantial wall of the main packing compartment is completed by front panel 40 sewn to the opposite edges of end panels 30 and 31.

While most of the packing compartments are contained within the main packing compartment, it has been found desirable to provide an envelope-like container on the outer face of panel 40, here shown as a gusseted pocket 42. It has been found desirable to keep the thickness dimension of the pocket 42 to a minimum, so that the lid pocket 90 can be deployed when the lid 10 is opened so that it hangs vertically on the front panel 40.

The lid construction is shown to include a flap 93 which includes a elastic closure type interior pocket 94. The upper edge of this pocket 94 comprises an elongated fabric tab 14 which serves as the hinge for the lid 10. Pocket 90 is attached to the interior face of lid 10 via integrally formed projecting tabs 91. These are sewn, along with the zipper track 12, to the edge of the lid 10. When completed, the overall structure is sewn to the top edge of panel 40 at the hinge flap 14.

Various buckle members, such as buckle 82, are fastened to the outer surface of the bag, either when completed or prior to completion or assembly. It is preferable that each of the buckles 82 and 84 are attached via a pivotable tab with a rivet or the like, so that these buckle members can be rotated on the rivet out of the way when not used or can adjust themselves at the proper angle when the carry strap S is pulled to support the weight of the bag.

Figure 4:
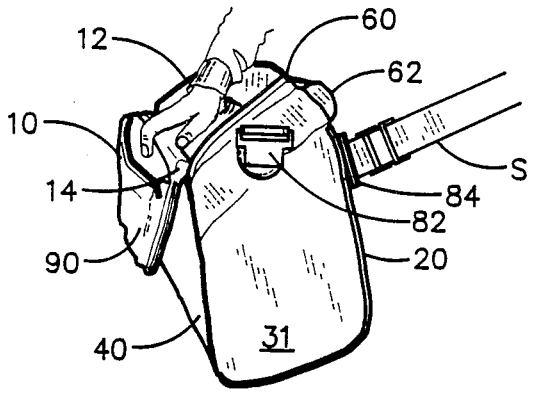
FIG. 4 shows the camera bag in use with the carry strap used as a waist strap.

The operation of the bag is remarkably simple and logical due to the careful placement of the various features. In FIG. 4, for example, the carry strap S is fastened to buckles 84 on the body side panel 20. Specifically, the handle 62 is held by the right hand of the user (as shown in FIG. 4), while the buckle 84 is attached and the strap S is adjusted in length to fit snugly to place the bag 1 on the hip or lower back of the user. The handle facet 60 thus provides a dual advantage to the user. First of all, since it is located on one of the highest points of the bag (that is, at the greatest vertical distance from the center of gravity of the packed case), it provides a remarkably stable configuration when the bag is carried by the handle. Secondly, because the handle facet is angled away from the body side panel, the handle remains easily accessible (relative to not being angled) for the user to support the bag either during operation of the strap S or merely carrying the bag by the handle.

The handle facet also aids in providing ready access to the main packing compartment. Specifically, in order to permit the lid 10 to fold outwardly and present a further packing compartment such as lid pocket 90, closure means must be operated along the upper edge of the lid closest to the body of the user. The handle facet spaces these closure means away from the side of the user so that they can be readily operated. There is no need to move the camera bag away from the body of the user when accessing these closures.

Figure 5:
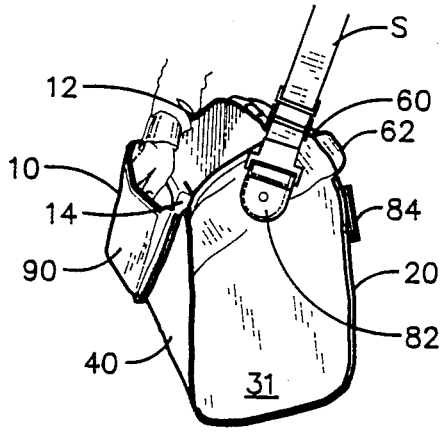
FIG. 5 shows the camera bag in use with the carry strap suspended from the shoulder of the user.

In FIG. 5, the strap S is positioned on buckle members 82. Preferably, the strap S is placed over the head of the user and across the shoulder on the opposite side of the body from the bag itself. Of course, strap S includes adjustment means to permit this strap to be lengthened and reach across the body of the user to the opposite shoulder. Here again, easy access to the handle 62 (because of the angled nature of the handle facet 60) permits supporting of the bag by hand during mounting of the shoulder strap S on to the opposite shoulder. Also, access to the closure means, such as the zipper 12 of the lid 10, is easily accomplished because of the provision of the handle facet.

Ready access to the lid pocket 90 is shown in both FIGS. 4 and 5. In use, the lid and lid pocket 90 may remain open during the photographic session, and yet contents, except under extreme conditions, do not spill out.

The lid, and thus the access opening provided by the lid, is angled away from the user. This angled nature makes manual access to the main packing compartment, as well as the lid pocket 90, remarkably convenient.

Note that the lid 10 and its zipper closure 12 forms an acute angle with the body side panel 20. Thus, when the bag is carried by the carry strap in either of the configurations shown in FIG. 4 or FIG. 5, the body side panel 20 is defined in a generally vertical orientation. This places the zipper 12, at least in that portion at the top of the end panels 30 and 31, at a substantial angle to the horizontal. This configuration provides substantial advantages when the zipper slides 13 are operated. This is so since the forces used to operate the zipper slides are primarily, or at least substantially, parallel and opposite to the resisting force provided by the strap about the shoulder or waist of the user (when the zipper pulls are being operated along the upper portions of panels 30 and 31 to open the bag), and up against gravity (when the zipper pulls are being operated to close the lid). This is unlike certain prior camera bags, for example, in the bag shown in U.S. Pat. No. 2,960,137. Here the lid is closed by a zipper arrangement, but the zipper slide movement is at substantial right angles to the resisting force provided by the shoulder strap. Thus, the bag must be restrained in some manner—usually by the other hand of the user—when the zipper slide is used to open and close the lid. This cumbersome operation is substantially eliminated by the instant invention.

The beneficial operation provided by the angled zipper closure 12 can also be had when the bag is being held or carried by the handle 62. If the shoulder strap is not being used, the bag, when suspended by handle 62, does not necessarily place the body side panel 20 in a vertical plane. However, in this case, the provision of the handle facet 60 adjacent to and at angles with the lid 10, and thus the zipper 12, permits the zipper to operate against the resisting force provided to the handle 62 or against the force of gravity when the zipper is being operated to close the lid 10.

Other configurations consistent with the essence of the invention as defined by the claims is contemplated. For example, an overall rectangular shape for the bag is shown. However, a more conforming shape, that is one that follows the curve of the side of the user, may be appropriate. Indeed, the preferred construction includes relatively soft materials which may permit the body side 20 to conform to the body of the user over a period of time.

Also, while the lid 10 is shown to form an acute angle with the body side panel 20, a bag could be constructed to have the lid form a right angle thereto and still gain benefit from the use of the handle facet 60 to provide a relatively high placement for the handle and to place the closure means 12 away from the side of the user for ready operation thereof. Although various buckles are shown to selectively attach the shoulder strap S to the bag, it is obviously expedient to eliminate one or either buckle set, or both buckle sets, and permanently attach the strap S to either the end panels or to the body side panel, or to the handle facet, so long as the strap S can be attached at a relatively high attachment point, thus providing stability for carrying the bag and resistive force for easy opertion of the lid closure zipper as outlined above. While a detailed construction has been shown, the scope of the invention is limited only by that of the appended claims.

I claim:

1. A hand luggage for carrying camera equipment and the like, comprising a bag having a bottom panel, an upper portion including an openable lid for access to a main packing compartment, first and second end panels, a body side panel and a front side panel in opposing relation to said body side panel, said front side panel having an upper edge means for pivoting said lid about said upper edge of said front side panel, means for attaching a carrying strap to said bag, said upper portion including a handle facet having a handle thereon, said handle facet is connected to and upwardly positioned from said body side panel and forms an angle with said body side panel and is positioned between said body side panel and said lid whereby when said bag is carried by said carrying strap with said body side panel against the body of the user of said bag, said lid is spaced away from the body of the user by said handle facet.

2. A hand luggage as set forth in claim 1 wherein said lid is a generally planar member which forms an acute angle relative to said body side panel.

3. A hand luggage as set forth in claim 2 wherein said lid is positioned at an angle relative to the horizontal when the bag is in use with the body side panel against the body of the user.

4. A hand luggage as set forth in claim 1 wherein said means for attaching said carrying strap includes buckle means positioned on each of said end panels approximate to said upper portion of said bag, whereby when said carrying strap is attached to said buckle means, said bag is carried in a generally upright position with said lid and said handle facet facing generally upwardly.

5. A hand luggage as set forth in claim 1 wherein the said handle comprises a loop of webbing sized, so that when carried by said user by said carrying strap, said handle faces the body of said carrier, yet is positioned so as to be accessible by the hand of said user, whereby the bag can be supported by said handle during placing or removing said carrying strap around said user.

6. A hand luggage as set forth in claim 1 wherein said lid includes releasable fastening means, whereby on release of said releasable fastening means, said lid may pivot away from the body of said user and hang substantially vertically in facing relationship with said front side panel.

7. A hand luggage as set forth in claim 6 wherein said lid includes a lid pocket positioned on the inside face thereof, said lid pocket including releasable closure means positioned along an edge of said lid pocket approximate to said upper edge means, whereby when said releasable fastening means of said lid is released and said lid is pivoted about said upper edge means, said lid pocket presents a second compartment accessible by the user, positioned outside the main packing compartment of said bag.

8. A hand luggage as set forth in claim 1 wherein said body side panel includes said means for attaching a carrying strap whereby said carrying strap can be fastened to said body side panel and placed around the waist of the user.

9. A hand luggage as set forth in claim 1 wherein said handle facet includes a length of webbing extending along its entire longitudinal dimension, a central portion of said webbing including a web loop forming said handle on the central portion of said handle facet.

10. A hand luggage as set forth in claim 1 wherein said lid comprises a generally planar member, and ends of said handle facet are connected to said end panels, said lid being releasably fastened to an edge of said handle facet and to upper edges of said end panels by a zipper closure means, such that when said bag is supported by said carrying strap with said body side panel against the body of the user, the force used to operate the zipper closure means, at least in those portions of said zipper closure means adjacent to the upper edge of said end panels, is in a direction opposite to the resisting force provided by the carry strap when the zipper pull is being operated to open said lid, and is in a direction generally against the force of gravity when the zipper closure means is being operated to close the lid.

11. A camera bag for carrying video camera equipment and the like comprising a main packing compartment defined by a lower portion including a bottom panel, first and second end panels, a body side panel and a front panel, an upper portion comprising a handle facet and a generally planar lid, said lid intersecting with said handle facet, said first and second end panels, and front panel: said lid comprising a majority of the upwardly facing parts of said upper portion and having means for releasably engaging said handle facet and said end panels so that said lid when closed engages with said handle facet and said end panels, said lid including pivot means along its intersection with said front panel, such that said lid may be opened to pivot about its intersection with said front panel, said lid forming a generally acute angle with said body side panel when said lid is closed and being positioned substantially parallel to said front panel when said lid is pivoted about said intersection with said front panel, said lid including a lid pocket positioned on the inside face thereof, such that said lid pocket is contained within said main packing compartment of said camera bag when said lid is in a closed position and said lid pocket is in an accessible, substantially vertical condition when said lid is in an open position, said handle facet including a carry handle for carrying said bag when said lid is in said open condition or when said lid is in said closed position.

12. A camera bag construction comprising a first web including a handle facet portion, a first end panel portion, and second end panel portion, said web comprising a substantially continuous lamina;

a generally planar body side panel;

a bottom panel integrally formed with said body side panel and extending at right angles thereto;

and a front panel having a generally rectangular planar shape;

said body side panel and bottom panel being fastened along a continuous edge portion thereof to said first web to form a seam with said handle facet portion and said first and second end panel portions, and said front panel being fastened at end portions of said first web;

said first and second end panel portions being spaced from one another, said body side panel extending at substantially right angles to said first and second end panel portions and spaced from said front panel, said handle facet portion forming an obtuse angle at its seam with said body side panel, and a lid attached at an upper edge of said handle facet portion, said end panel portions, and said front panel, whereby when assembled, a main packing compartment of said bag is formed.

* * * * *